United States Patent [19]

Walter

[11] 4,250,498

[45] Feb. 10, 1981

[54] LIGHT BARRIER RECEIVER

[75] Inventor: Arthur Walter, Waldkirch, Fed. Rep. of Germany

[73] Assignee: Erwin Sick GmbH, Optik-Elektronik, Waldkirch, Fed. Rep. of Germany

[21] Appl. No.: 38,323

[22] Filed: May 11, 1979

[30] Foreign Application Priority Data

May 19, 1978 [DE] Fed. Rep. of Germany ... 7815175[U]

[51] Int. Cl.[3] ..... G08B 13/18

[52] U.S. Cl. ..... 340/556; 340/693; 361/395

[58] Field of Search ..... 340/556, 693; 361/395, 361/399

[56] References Cited

U.S. PATENT DOCUMENTS 3,356,904 12/1967 Yonkers ..... 361/399

3,668,476 6/1972 Wrabel et al. ..... 361/395

4,156,883 5/1979 Walter et al. ..... 340/556

*Primary Examiner*—Glen R. Swann, III

[57] ABSTRACT

A transmitting lens and a receiving lens are arranged alongside each other on one narrow side of a shallow housing so that a pencil beam of light transmitted by the transmitting lens and reflected by a separate reflector is received by the receiving lens and concentrated onto a photoelectric converter. Interruption of the pencil beam of light results in interruption of the output signal from the photoelectric converter and is detected and used to actuate an alarm signaller located within the housing. The alarm signaller, which is preferably a buzzer, is connected with the housing to form a single constructional unit. The optics and electronics are conveniently mounted on a circuit board which is conveniently located within the housing and secured by a resilient cushion.

20 Claims, 4 Drawing Figures

LIGHT BARRIER RECEIVER

BACKGROUND OF THE INVENTION

The present invention relates to a light barrier receiver and has a particular reference to a light barrier receiver having a shallow housing with a receiving lens arranged at one narrow side thereof the receiving lens concentrating the light received on a photoelectric converter arranged behind the lens, the photoelectric converter allowing response of an alarm signaller, following interruption of the light beam of the light barrier, via a processing circuit which is likewise contained in the housing.

It is known that optical or acoustic warning signals can be initiated by interruption of a light barrier in order to make an operator aware than an obstacle is located in the beam of the light barrier. The accommodation of an acoustic alarm signaller requires, however, additional space and necessitates electrical connecting cables between the light barrier receiver and the alarm signaller.

A first object of the present invention is thus to provide a light barrier receiver of the kind previously named which obviates the need for a special arrangement of an acoustic alarm signaller and its associated electric connecting cables.

THE INVENTION

For solving this task the invention provides that the alarm signaller is connected with the housing to form a single constructional unit. In particular, the alarm signaller is mounted inside the housing. In accordance with the invention a special mounting of the acoustic alarm signaller and its connection with the light barrier receiver is thus superfluous as the alarm signaller is integrated with the housing of the light barrier receiver in the first place. As acoustic alarm signallers can today be manufactured as buzzers of small constructional dimensions the housing of the light barrier receiver hardly needs to be larger than customary.

It is especially advantageous if the alarm signaller is fastened to a circuit board arranged inside the housing and extending parallel to the two large area walls thereof. The circuit board is usefully arranged on one of the two large area wals so that the alarm signaller extends from there to the opposite wall. In this way the entire width of the housing is used in advantageous manner for accommodating the alarm signaller. The two large area walls of the housing are usefully defined by injection moulded base and cover parts respectively which are themselves provided with side walls which cooperate to define the narrow sides of the housing. The mating side wall edges conveniently define a split line for the housing and are usefully provided with cooperating location features such as a ridge and a groove.

It is a further object of the present invention to provide a light barrier receiver which can be readily assembled and in which the individual components are located within the housing by simple means which obviate the need for complicated and expensive location devices. In particular it is an object of the present invention to provide an arrangement in which the electronic and optical components can all be mounted on a circuit board and to so construct this circuit board and its associated housing that the two can be readily assembled.

A particular form of the invention suitable for achieving the above objects is characterized in that the housing comprises at least base and cover parts, said cylindrical positioning pin means is provided on at least one of said base and cover parts; that the receiving lens, the photoelectric converter, the alarm signaller and associated electronic equipment are mounted on a circuit board, the circuit board has a hole of diameter equal to said cylindrical spigot means and is located thereover, there being further provided resilient means bearing on the circuit board to secure the circuit board in position by rotationally biasing the circuit board about the positioning pin against stop means.

In this way the circuit board together with the components mounted thereon can be readily assembled into the housing by compressing the resilient means with one edge of the circuit board and slipping the hole in the circuit board over the positioning pin means. After assembly the resilient means ensures that the circuit board is held in the correct position.

The alarm signaller can be arranged in a variety of positions within the housing. In particular when the alarm signaller is of the acoustic variety it is advantageously further arranged that the alarm signaller finishes shortly before the cover wall and that the cover wall is provided with an arrangement of apertures in the vicinity of the alarm signaller. the relevant part of the cover wall that is provided with the arrangement of apertures is preferably removable so that the acoustic alarm signaller can without further ado be built in when the wall is removed and so that any adjustment members are accessible when the wall is removed. The sound of the acoustic alarm signaller is able to leave without hindrance when the cover wall is in place via the arrangement of apertures.

Usefully the alarm signaller is a cylindrical buzzer with sound exit openings provided in an end face thereof which are directly adjacent to the arrangement of apertures.

A constructionally exceptionally balanced arrangement is achieved by arranging the optical arrangement on one side of, and the alarm signaller on the opposite side of, a securing bore which passes transversely through the housing.

A timing element which is preferably adjustable by hand can be mounted inside the housing alongside the alarm signaller. The timing element can be actuated from outside when the wall or a part of the wall is removed e.g. by means of a screw driver. The arrangement can be such that the acoustic signal sounds for the entire period for which the light barrier is interrupted. It is, however, also possible to make the arrangement such that a buzzer signal of constant duration sounds for each interruption of the light beam. The duration can be adjusted via the timing element from e.g. 2 to 10 seconds. It is further possible to provide a minimum timing element by means of which short period interruptions of the beam of the light barrier also sounds the acoustic signal for a specified minimum duration of e.g. from 2 to 10 seconds.

It is especially advantageous if a transmitting lens is mounted above or below the receiving lens in the said narrow side of the housing. In this case the light source is also housed in the light barrier receiver. The beam of the light barrier is directed through the transmitting lens to the receiving lens via a retroreflector arranged at the end of the path to be monitored. In this preferred embodiment of the invention all the elements which need an electrical supply are thus arranged in a single housing so that solely a single electrical connection which leaves the housing is sufficient.

The base and cover parts can conveniently be connected together by means of a throughgoing bolt, which passes through the afore-mentioned securing bore, and the end of which is engaged with a mounting bracket.

The securing bore can conveniently pass through the afore-mentioned cylindrical positioning pin means which is itself usefully constructed as a spacer member extending between base and cover parts.

To prevent excessive tightening of the bolt collapsing the housing an insert, preferably of metal, is usefully provided in the cylindrical positioning pin means, the insert having a central portion and two end portions at least one of which is releasably fitted to the central portion and the two end portions are arranged to fit in counter bores at each end of the securing bore. In this way the clamping loads from the securing bolt to the mounting bracket are carried principally by the insert.

If the end parts of the insert, or at least one of them, is connected by screw threads to the central portion then the insert can conveniently be used to clamp together cooperating base and cover parts of the housing.

The mounting bracket can usefully be provided with a friction surface at its side adjacent the housing so that on tightening the securing bolt the housing is locked by friction against rotation.

Preferably the mounting bracket for the housing is an angled bracket one limb of which extends along the wall remote from the sound exit wall. The mounting bracket can have an inwardly turned limb at the point where it projects beyond the housing and securing bores can be arranged in this limb.

A supply cable for the direct supply of all constructional elements from the supply is preferably introduced into a narrow side of the housing.

Moreover, an indicator lamp can be arranged in a narrow side of the housing and can be trapped by a flange in cooperating grooves formed in the side walls of the base and cover parts.

The invention thus provides a compact light barrier which is preferably used for securing doors or for controlling the passage of individuals. A particular advantage resides in the fact that the light barrier can be directly connected to the mains supply and simultaneously that without additional trouble or expense an acoustic signal is given when the light barrier is interrupted.

BRIEF DESCRIPTION OF THE DRAWING

Other objects and advantages of the present invention will become apparent from the subsequent disclosure.

The invention will now be described in the following by way of example only and with references to the drawings which show.

DETAILED DESCRIPTION OF PREFERRED EMBODIMENTS

Figure 1:
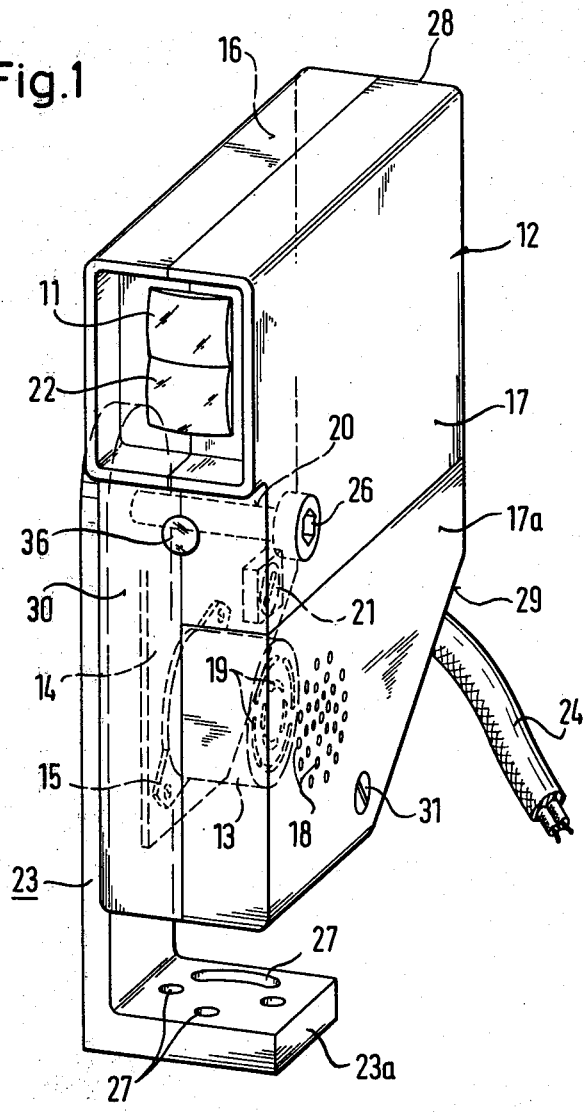
FIG. 1 a schematic perspective view of a light barrier receiver united with a light transmitter, FIG. 2 a plan view of the circuit board illustrated in broken lines in the diagram of FIG. 1, FIG. 3 a plan view of the base part of the housing of FIG. 1 illustrating detail thereof, and FIG. 4 a front view of the housing of FIG. 1 showing details of its assembly.

Turning firstly to FIG. 1 there is shown a light barrier transmitter/receiver with a housing 12 connected to a mounting bracket 23 via a securing bolt 26. The housing 12 basically comprises a base part 16 which defines one large area wall thereof and cover parts 17 and 17*a* which define a second large area wall thereof. The base and cover parts are respectively provided with cooperating side walls which meet at a line defining a split line for the housing. The optical part of the arrangement comprises a transmitting lens 22 which transmits light from an associated light source towards a retroreflector (not shown) and the light beam reflected from the retroreflector is received by receiving lens 11 and concentrated on an associated photodetector (not shown in FIG. 1). The transmitting lens and receiving lens are united to a single unit which, as will be later explained, is fastened to a circuit board 14 and the lenses themselves are located in a window formed in a narrow side of the housing 12.

Electronic circuits for light barrier receivers and in particular light barrier transmitter/receivers are well known in the art and the precise details of their electronic construction are not material to the present invention.

Figure 2:
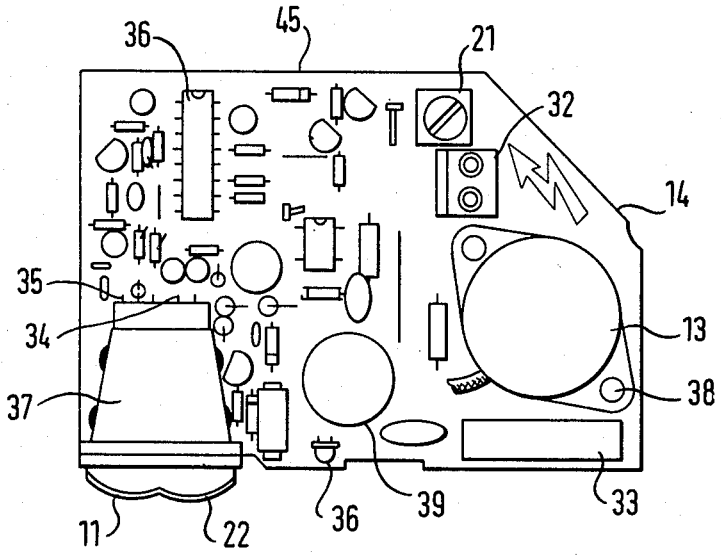

Referring now to FIG. 2 there can be seen the circuit board 14 together with an illustration of a preferred layout for the electronic components of the light barrier transmitter receiver unit. The important components are the terminal block 32 for connection to a main power supply, a rectifier unit 33 which provides DC power supplies of an appropriate voltage for the other electronic components and in particular the lamp 34 of the transmitter/receiver unit 37 22. The signal received from the photoelectric converter 35 is processed by electronic circuitry 36 and is used to initiate an alarm signaller in the form of the buzzer 13. Optical extras include an indicating lamp 36 which indicates the operation of the device and a potentiometer 21 which enables the duration for which the alarm signaller is operative following interruption of the light barrier to be varied. All components are rigidly mounted on the circuit board in particular the buzzer is fixed by screw threaded or riveted fastening 38 and the transmitter/-receiver unit is conveniently glued to the circuit board with e.g. an epoxy resin glue.

A feature of the arrangement is the circular hole 39 provided in the circuit board. This hole is arranged to engage over a cylindrical positioning pin formed on the base part of the housing. This positioning pin 40 can conveniently be seen by referring also to FIG. 3. In operation the circuit board is supported on pedestals 41 projecting from the base of the housing and the transmitter/receiver unit 37 is urged into contact with the window 42 of the housing by means of a resilient cushion 43 located against the back side wall 44 of the base part. To insert the circuit board into its position on the base part it is merely necessary to press the edge 45 of the circuit board against the resilient cushion and to slip the circular hole over the circular positioning pin 40 so that the circuit board 14 rests on the pedestals 41. The resilient force provided by the resilient cushion then ensures that the light transmitter/receiver unit 37 contacts the frame defining the window 42 and readily allows any expansion of the circuit board that may occur due to heat dissapation in the electronics etc.

Figure 3:
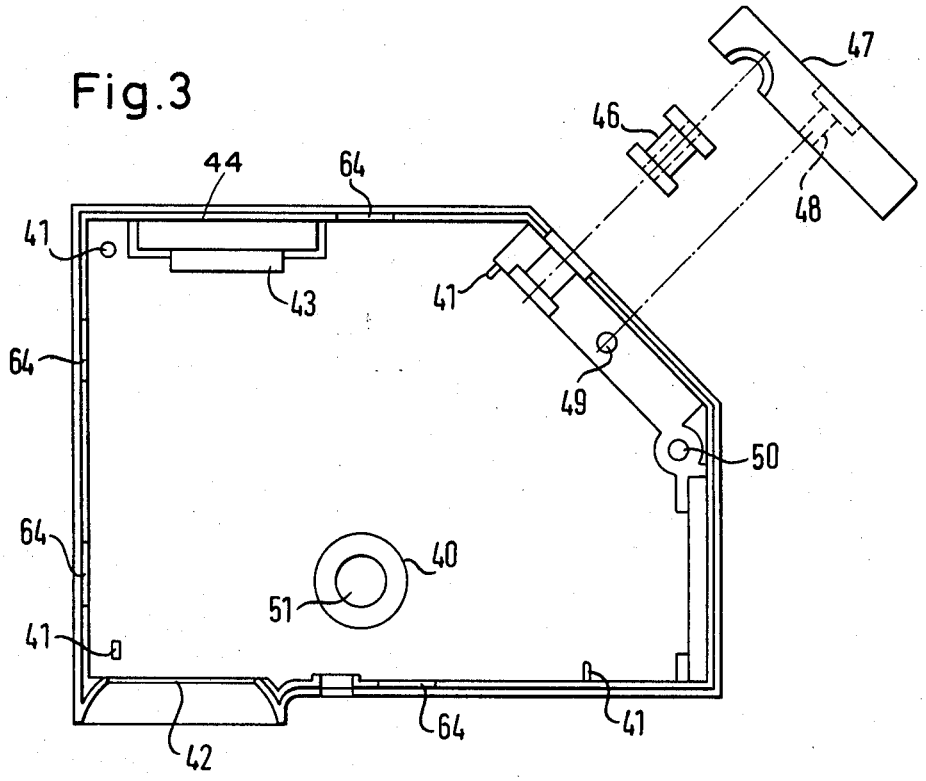

FIG. 3 also allows a number of other features to be recognized in particular a sleeve 46 for locating the input lead from the mains and an associated sleeve clamp 47 which can be secured to the base part of the housing by means of a screw (not shown) but which passes through the bore 48 into the screw threads 49. A further screw threaded bore 50 is provided to accommodate the screw 31 which secures the casing part 17*a*.

Figure 4:
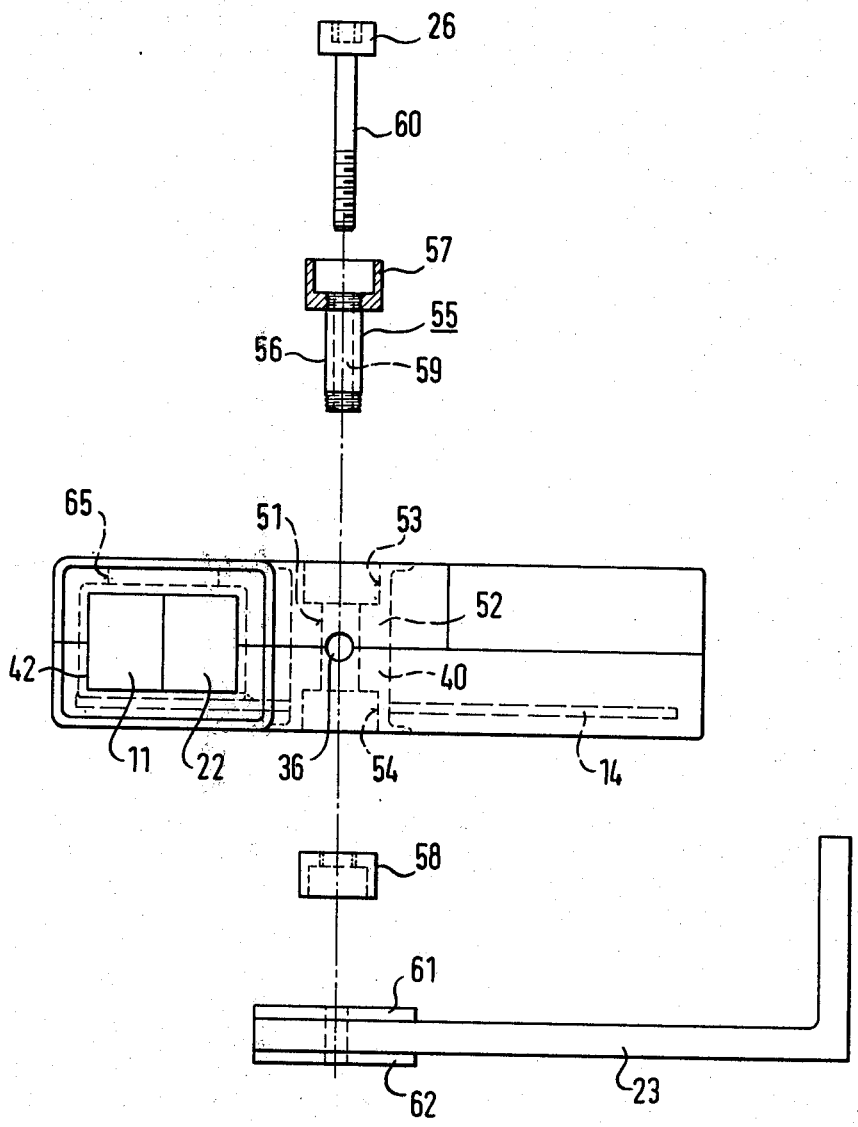

A further feature of the design which can be more readily appreciated by referring also to FIG. 4 is the detail of the securing bore 51 which is arranged coaxially through the cylindrical positioning pin.

From FIG. 4 it can be seen that the cylindrical positioning pin 40 in the base part abuts a corresponding cylindrical positioning pin 52 in the cover part 17. The bore 51 extends through both cylindrical positioning pin and counter bores 53, 54 are provided at each end thereof. The purpose of these counter bores is to accommodate a metal insert shown generally at 55. The metal insert 55 has a central portion 56 and two end parts 57 and 58 at least one of which is releasably fitted to the central portion, in this case by means of screw threads. The insert 55 has itself a central bore 59 which accommodates the shank 60 of the securing screw 26. The insert allows the securing bolt 26 to be tightened onto the mounting bracket 23 without collapsing the housing. Furthermore the mounting bracket 23 is provided with friction faces 61 and 62 which cooperate with the part 58 of the insert and or the base 16 to prevent relative rotation between the mounting bracket and the housing.

The mount 23 has a shallow elongate form and extends downwardly from the bolt 26 beyond the outer border of the housing 12 where it has an angular extension 23*a* which extends along the narrow side of the housing. Various fastening bores 27 are provided in the extension 23*a*. The spacing of the extension 23*a* from the narrow side of the housing 12 is sufficiently large that the holder can be pivoted almost completely around the housing 12. Solely the upper right hand corner 28 and the supply cable 24 which is introduced through a cut off corner 29 of the housing limit the range of pivotal movement of the holder 23.

As can be seen from FIG. 1 the buzzer 13 extends to the oppositely disposed cover part 17*a* which can be separately removed after releasing the screw 31. This cover part 17*a* has an arrangement of apertures 18 opposite to the sound exit slots 19 through which the buzzer sound can exit without restriction.

On the circuit board 14 alongside the buzzer 13 there is arranged an adjustable timing element 21. After removal of the wall part 17*a* the timing element 21 can be adjusted by hand on inserting a screw driver for setting the duration of the buzzer sound.

The base part 16 and cover part 17 and 17*a* can conveniently be provided with cooperating ridges and grooves which ensure accurate alignment thereof. In particular a ridge 63 can be seen on the base part 16 in FIG. 3. In addition the base and cover parts can be secured together in known manner by resilient latch members provided on the cover parts which spring into corresponding undercut recesses 64 in the base part. All housing parts can conveniently be injection moulded in plastic.

As can be seen at 65 in FIG. 4 a further resilient cushion is provided which is located between the cover part 7 and the circuit board 14 and which bears on the transmitter receiver unit 37 to urge the circuit board into contact with the pedestals 41. Both the resilient cushions 43 and 65 can e.g. be of rubber and can be glued to their respective housing parts. The use of such terms as base, cover and pedestal will be understood to be purely for convenience and not as restricting the geometrical position in which the device may be used.

It will be appreciated by those skilled in the art that modifications will be made to the arrangement as described herein without departing from the scope of the present teaching.

It will be further appreciated that the manner in which the circuit board is arranged within the housing can also be readily applied to other devices than light barrier receivers.

What we claim is:

1. A light barrier receiver having a shallow housing comprising at least base and cover parts, a receiving lens arranged to one narrow side of the housing and adapted to concentrate a received light beam on a photoelectric converter arranged behind the lens, at least one of the base and cover parts incuding cylindrical positioning pin means, the photoelectric converter being adapted to allow response of an alarm signaller following interruption of the light beam of the light barrier receiver via a processing circuit, said receiving lens, photoelectric converter and alarm signaller and the processing circuit being mounted on a circuit board, the circuit board having a hole of a diameter equal to said cylindrical positioning pin means and being located thereover and resilient means bearing on the circuit board to secure the circuit board in position by rotationally biasing the circuit board about the positioning pin means against stop means.

2. A light barrier receiver according to claim 1, wherein said stop means comprises corresponding abutment faces on the receiving lens and the housing.

3. A light barrier receiver according to claim 1, wherein said resilient means comprises a resilient cushion interposed between the housing and an edge of the circuit board.

4. A light barrier receiver according to claim 1, comprising pedestal means on at least one of said base or cover parts for locating the circuit board relative to the housing.

5. A light barrier receiver according to claim 1 and characterized in that further resilient means is interposed between at least one of said base and cover parts and the circuit board.

6. A light barrier receiver according to claim 5, wherein said further resilient means comprises a resilient cushion bearing on an optical unit including the receiving lens.

7. A light barrier receiver according to claim 1, wherein said cylindrical positioning pin means forms a spacer member located between said base and cover parts and has a central bore with counter bores at each end thereof, an insert member with a central portion and two end portions, at least one of said end portions being releasably fitted to said central portion, said insert member being adapted to receive the head and shank of a throughgoing securing bolt the threaded end of which is engageable with a mounting bracket.

8. A light barrier receiver according to claim 7, wherein said mounting bracket has a friction grip surface of at least one side thereof for frictionally engaging the insert on tightening said securing bolt.

9. A light barrier receiver according to claim 8, wherein said mounting bracket is reversable and has friction grip surfaces on both sides.

10. A light barrier receiver according to claim 1, wherein said circuit board is arranged adjacent one of the two large area walls of the housing and the alarm signaller extends from there to the opposite wall.

11. A light barrier receiver according to claim 10, wherein said alarm signaller ends shortly before said opposite wall and wherein said opposite wall is provided with an arrangement of holes in the vicinity of the alarm signaller.

12. A light barrier receiver according to claim 1, wherein said alarm signaller is a cylindrical buzzer with sound exit apertures provided in an end face thereof.

13. A light barrier receiver according to claim 1, wherein said receiving lens and said photoelectric converter are arranged in front of, and the alarm signaller behind, said cylindrical positioning pin means.

14. A light barrier receiver according to claim 1, wherein a timing element adjustable by hand is mounted in the housing alongside the alarm signaller.

15. A light barrier receiver according to claim 1, wherein a transmission lens is mounted in the said narrow side of the housing above the receiving lens.

16. A light barrier receiver according to claim 1, wherein a transmission lens is mounted in the said narrow side of the housing below the receiving lens.

17. A light barrier receiver according to claim 9, wherein the mounting bracket extends along the wall remote from the wall having said arrangement of holes.

18. A light barrier receiver according to claim 17, wherein said mounting bracket is an angled bracket having an inwardly turned limb at the point where it extends beyond the housing.

19. A light barrier receiver according to claim 1, wherein a supply cable for feeding electrical power to the receiver is introduced from the supply into a narrow side of the housing.

20. A light barrier receiver according to claim 1, wherein an indicator lamp is arranged in a narrow side of the housing.

* * * * *